US010143243B1

(12) United States Patent
Bardy

(10) Patent No.: US 10,143,243 B1
(45) Date of Patent: Dec. 4, 2018

(54) BLOUSE WITH A DETACHABLE EMBLEM FOR IDENTIFYING A CAPTAIN OF A SPORTS TEAM

(76) Inventor: Christopher Albert Bardy, White Lake, MI (US)

( * ) Notice: Subject to any disclaimer, the term of this patent is extended or adjusted under 35 U.S.C. 154(b) by 1148 days.

(21) Appl. No.: 11/899,684

(22) Filed: Sep. 10, 2007

Related U.S. Application Data

(63) Continuation-in-part of application No. 11/075,290, filed on Mar. 8, 2005.

(51) Int. Cl.
*A41B 11/00* (2006.01)

(52) U.S. Cl.
CPC ..... *A41B 11/001* (2013.01)

(58) Field of Classification Search
CPC ..... A41B 11/001
USPC ..... 40/661.04, 662, 668, 315, 1.5; 24/114.05; 63/20; D11/41, 46, 95, 116
See application file for complete search history.

(56) References Cited

U.S. PATENT DOCUMENTS 1,589,158 A * 6/1926 Hedison ..... 63/20
2,530,453 A * 11/1950 Eagle ..... 2/247
2,667,004 A * 1/1954 Sanson ..... 24/106
4,344,240 A * 8/1982 Schiller ..... 40/662
5,357,660 A * 10/1994 Smith ..... 24/662
5,422,173 A * 6/1995 Stahl ..... 428/189
5,946,732 A * 9/1999 Richards ..... 2/247
6,178,680 B1 * 1/2001 Sloot ..... 40/668
2003/0054137 A1 * 3/2003 Kisha et al. ..... 428/193
2005/0011092 A1 * 1/2005 Bruscini ..... 40/1.6

OTHER PUBLICATIONS

"1984 NHL Campbell Conference All Star #99 Wayne Gretzky Throwback Jersey," http://zontals.org/454627337.html, Dec. 1984.*

* cited by examiner

*Primary Examiner* — Gary C Hoge
(74) *Attorney, Agent, or Firm* — Alex Rhodes

(57) ABSTRACT

A rapid easy to use detachable emblem and method for designating a member of a sports team. The emblem is inscribed with an alpha numeric character that designates the position of the member of the sports team, a backing for retaining the emblem to a garment; and a mechanical closure for interlocking the emblem with the garment and the backing. The method is comprised of placing the emblem against an outer surface of the garment, placing the backing against an inner surface of the garment opposite the emblem and interlocking the emblem with the garment and backing by engaging the members of a two-part mechanical closure. In a second embodiment, multiple mechanical closures are used for attaching the emblem to the garment.

7 Claims, 3 Drawing Sheets

30

30

BLOUSE WITH A DETACHABLE EMBLEM FOR IDENTIFYING A CAPTAIN OF A SPORTS TEAM

CROSS REFERENCE TO RELATED APPLICATIONS

This is a continuation-in-part of application Ser. No. 11/075,290, filed Mar. 8, 2005.

FIELD OF THE INVENTION

This invention relates to lettering materials and methods and more particularly to an efficient, easy to use detachable emblem and method for designating captains and assistant captains of sports teams without tools and special equipment.

BACKGROUND OF THE INVENTION

The appointment of captains and assistant captains is a widespread practice in sports teams. Captains are used in ice hockey, football, soccer, fencing, golf, skiing, indoor volleyball and intramural teams. Many captains and their assistants have special powers. For example, in ice hockey, only captains and assistant captains have "the: privilege: of discussing with . . . a referee any questions relating to interpretation of rules that may rise during the progress of a game". (USA Hockey Rules).

Upper case "C" and "A" letters are permanently affixed to blouses by silk-screening, sewing and adhesives. These processes require special equipment and in general cannot be used to immediately designate a captain or assistant captain on a blouse.

Liebe, Jr, U.S. Pat. No. 3,660,212; Hix, U.S. Pat. No. 4,264,666; Mahn, Sr. et al, U.S. Pat. No. 4,610,904; So, U.S. Pat. No. 4,717,621; Dressler, U.S. Pat. No. 5,312,645; and Stahl et al., U.S. Pat. No. 6,194,044 are exemplary of athletic lettering in the prior art.

Liebe, Jr., issued on May 2, 1972, discloses athletic lettering formed by knife spreading heat curable plastic on to a high-gloss release sheet and cutting out the lettering on the sheet. The lettering is joined to a garment by ironing at a temperature which is sufficient to fuse the lettering to the garment.

Hix, issued on Apr. 28, 1981, discloses athletic words or expressions formed by die cutting alphabet characters and script-type interconnections from a material that heat and pressure serves to bond the words or expression letters to a garment.

Mahn, Sr., issued on Sep. 9, 1986, discloses an emblem for clothing having a lower thermoplastic layer and a thermoset ink upper layer. The emblem is suitable for laundering at wash temperatures of 400 degrees F. and dryer temperatures of about 500 degrees.

So, issued on Jan. 5, 1988, discloses a multi-layer emblem comprised of an outer plastic layer that provides a visual display of an indicium cut from the material, a bonding layer of thermoplastic material bonded to the labeling layer and a pressure-sensitive adhesive on the other surface of the bonding layer. The adhesive layer provides temporary adhesion of the indicium to a textile fabric until heat and pressure are applied to activate the bonding layer and forms a permanent bond to the fabric.

Dressler, issued on May 17, 1994, discloses an emblem having at least one layer of pigmented polyurethane thermoplastic material and a transparent polyester plastic film carrier sheet. A die cutting computer controlled blade produces small letters that may be connected or separated from each other without penetration of the blade through the carrier sheet. The emblem is attached to a garment by heat and pressure.

Stahl, issued on Feb. 27, 2001, discloses an emblem for embroidery stitching. The emblem includes a fabric layer with a thermoplastic adhesive coating on one side of the fabric layer and a pressure sensitive adhesive coating that can be temporarily secured during embroidery to prevent distortion of the emblem. The emblem is heat-sealed to a substrate for attachment of the emblem.

Professional teams who can easily afford expensive new blouses seldom change captains and assistants. Amateur and scholastic sports teams frequently change captains and assistants but often do not change blouses because of cost and timing.

Captain and assistant captain positions are eagerly sought after and assigned to the "best" players of a team. A detachable, ready, easy to use emblem would allow coaches and athletic staffs to set player goals, make awards and develop leadership qualities in young athletes. It would reduce school, amateur and intramural sports costs and improve the functioning of a game.

SUMMARY OF THE INVENTION

With the foregoing problems in mind, a primary object of the invention is to provide an easy, ready to use, low cost emblem and method for designating captains and assistant captains on blouses and sweaters. Although directed to captains and their assistants of ice hockey teams, the invention can be applied to other sports and to designate team names, player names and player numbers on blouses and sweaters. Another benefit is that it can be applied to garments without special tools or equipment. Another benefit is that it can be immediately used to revise designs and indicia on blouses and sweaters. Another benefit is that captains and their assistants can always be designated on short notice, absences and last minute changes. Another benefit is that it can sustain heavy body contacts.

The invention is comprised of a thin flexible multi-layer emblem, a thin flexible backing and a mechanical closure for attaching the emblem to a garment. The emblem can consist of single numerals or letters, words, expressions and/or designs. In a first embodiment of the invention, an emblem is attached to a garment with a single mechanical fastener. A distinguishing feature of the invention is that the emblem is detachable. Another distinguishing feature is that the mechanical closure joins the emblem to the garment without piercing the garment. Another distinguishing feature is that the mechanical closure acts on opposite sides of the garment. In a second embodiment, an emblem is attached to a garment with plural fasteners.

In employing the teaching of the present invention, a plurality of alternate constructions can be used to achieve the objectives, desired results and capabilities of the invention without departing from the spirit thereof. In this disclosure, only two embodiments are presented for the purpose of disclosing my invention. However, these embodiments are intended as examples only and should not be considered as limiting the scope of my invention.

The foregoing features, benefits, objects and best mode of practicing the invention and additional benefits and objects will become apparent from the ensuing detailed description of a preferred embodiment and the subject matter in which exclusive property rights are claimed is set forth in the numbered claims which are appended to the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating a presently preferred specific embodiment of the invention by way of non-limiting example only.

DETAILED DESCRIPTION OF A PREFERRED EMBODIMENT

Figure 1:
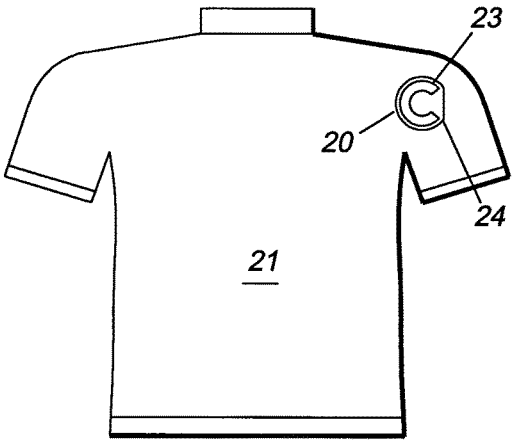
FIG. 1 is a front view of a blouse with a detachable emblem containing the capital letter "C" for designating the captain of a sports team.
Figure 2:
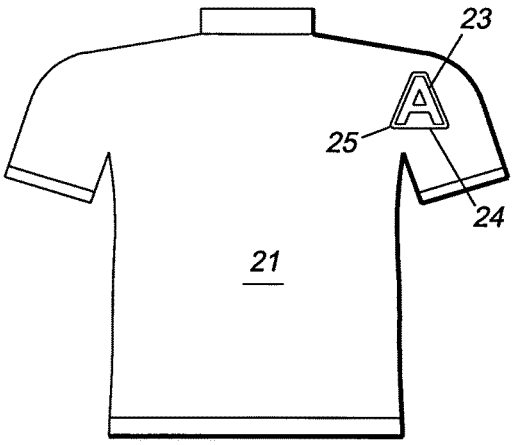
FIG. 2 is a front view of a similar blouse with a detachable emblem containing the capital letter "A" for designating the assistant captain of a sports team.
Figure 3:
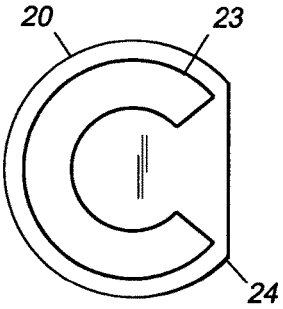
FIG. 3 is an enlarged front view of an overlying layer of the multi-piece emblem of FIG. 1 containing the letter "C".
Figure 4:
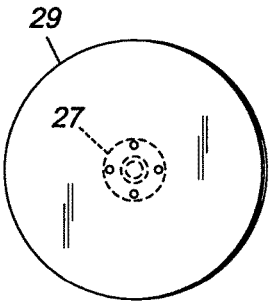
FIG. 4 is a front view of the underlying layer of the emblem of FIG. 3.
Figure 5:
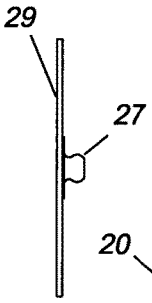
FIG. 5 is a left end view of the underlying layer of the emblem of FIG. 3.
Figure 6:
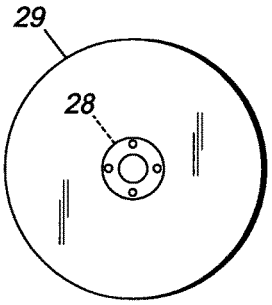
FIG. 6 is an enlarged front view of a backing for the emblem of FIG. 1.
Figure 7:
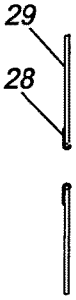
FIG. 7 is a left end view of the backing for the emblem of FIG. 1.

Referring now to the drawings wherein like numerals designate like and corresponding parts throughout the several views, in FIGS. 1 and 2, blouses for captain and assistant captains are shown according to the invention. With reference to FIG. 1, a thin flexible multi-piece emblem 20 containing the letter "C" is attached to the left shoulder area of a blouse 21. One distinguishing feature of the emblem 20 is that it is attached to the blouse with a single "quick connect" mechanical closure 22. The emblem is attached without special tools or equipment. The construction of the multi-piece emblem 20 in FIG. 1 is best understood by reference to FIGS. 3 through 8. The emblem 20 is comprised of a thin flexible overlying layer 23 having the shape of the letter "C" and a thin flexible underlying layer 24. The underlying layer 24 extends beyond the borders of the overlying layer 23, forming a decorative border. In FIG. 2, except for the letter "A" in place of the letter "C", the construction of the emblem 25 in FIG. 2, is similar to the emblem 20 of FIG. 1.

The mechanical closure 22, commonly designated as a snap fastener 22 and sometimes as a popper and press stud, is comprised of a stud 27 which is attached to the underside of the underlying emblem layer 24 and a socket 28 that is attached to the overside of a thin flexible backing 29. Numerous variations of snap fasteners exist in the art, including stamped and molded fasteners, that are suitable for practicing the invention. In FIGS. 1 and 2, the letter "C" designates a team captain and the letter "A" his assistant.

Figure 8:
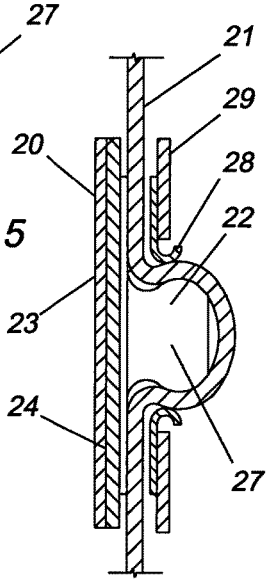
FIG. 8 is an enlarged cross-sectional view taken on the line 8-8 in FIG. 3.
Figure 9:
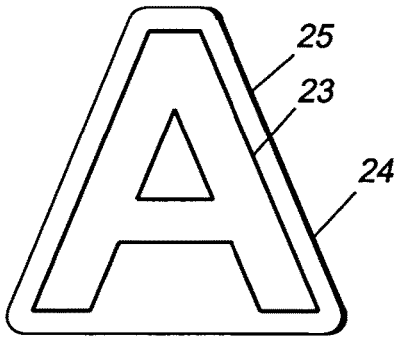
FIG. 9 is an enlarged front view of an overlying layer of the multi-piece emblem of FIG. 2 containing the letter "A".
Figure 10:
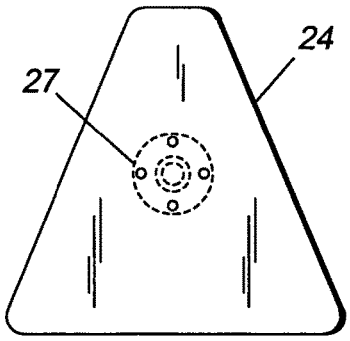
FIG. 10 is a front view of the underlying layer of the emblem of FIG. 9.
Figure 11:
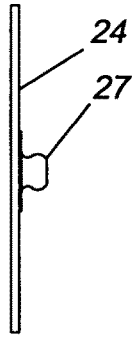
FIG. 11 is a left end view of the underlying layer of the emblem of FIG. 9.
Figure 12:
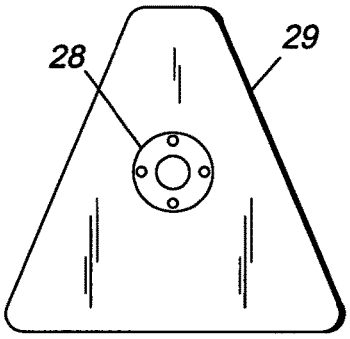
FIG. 12 is an enlarged front view of the backing for the emblem of FIG. 2.
Figure 13:
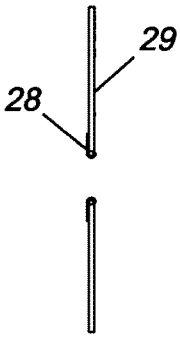
FIG. 13 is a left end view of the backing for the emblem of FIG. 2.
Figure 14:
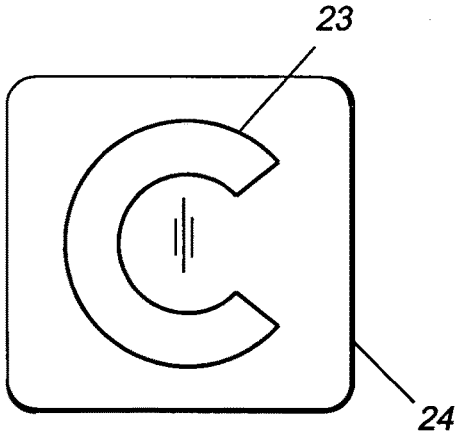
FIG. 14 is an enlarged front view of an overlying layer of a second embodiment of the emblem containing the letter "C".
Figure 15:
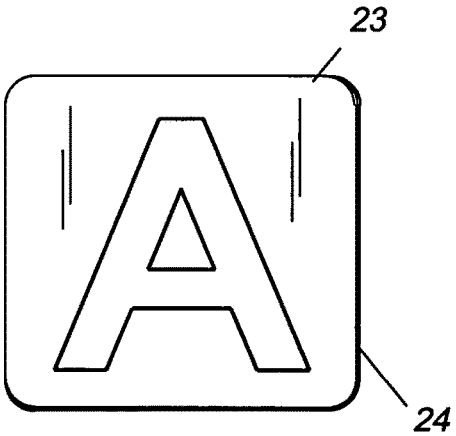
FIG. 15 is an enlarged front view of an overlying layer of a second embodiment of the emblem containing the letter "A".
Figure 16:
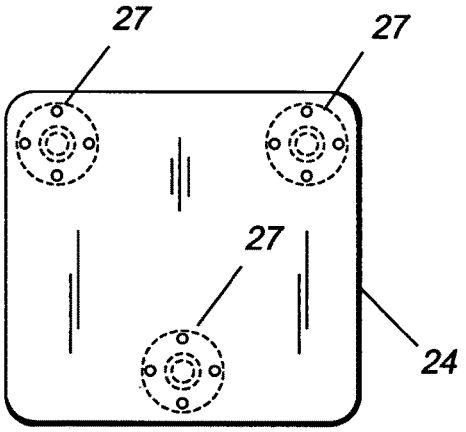
FIG. 16 is an enlarged front view of an underlying layer of the second embodiment of the multi-piece emblem containing the letter "C".
Figure 17:
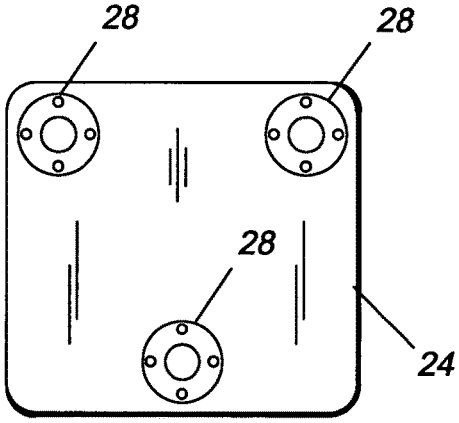
FIG. 17 is an enlarged front view of a backing for the emblem of FIGS. 14 and 15.

With reference to FIG. 8, several methods are available for practicing the invention. In a first method, the emblem (not shown) is a single layer emblem. Letters are silk screened onto a thin piece of fabric or plastic and the fabric or plastic is die or laser cut. The stud 27 is attached by sewing, crimping, clinching or adhesion. The backing 29 is then made by die or laser cutting a thin piece of plastic and the socket 28 is attached. The final steps consist of placing the emblem 20 on the front side of the garment 21, placing the backing 29 on the rear side of the garment 21 opposite the emblem 20, and engaging the stud 27 with the socket 28 to attach the emblem 20 to the garment 21.

In a second method, a thin piece of fabric or plastic is die or laser cut and the stud 27 is attached to the underlying layer 23 of the emblem 20. The overlying layer 23 is die or laser cut from a thin piece of fabric or plastic. The backing 29 is made by die or laser cutting a thin piece of plastic and the socket 28 is attached. The final steps can be done in two ways. In a first way, the emblem underlying layer 24 is placed against the outer side of the garment 21, the backing 29 is placed against the inner side of the garment 21 opposite the emblem underlying layer 24, the stud 27 and socket 28 are engaged and as a final step the overlying layer 23 of the emblem 20 is adhesively attached to the underlying layer 24.

The third method is the same as the second method, except that the overlying emblem layer 23 is attached to the underlying layer 24 by sewing, adhesive or heating and fusing before the emblem 20 is placed against the outer side of the garment 21 and the stud 27 is engaged with the socket 28. The fourth method is the same as the third method except the overlying layer 23 is joined to the underlying layer 24 with the stud 27 attached and the overlying 23 and underlying 24 layers are laser cut at the same time.

Referring again to FIG. 8, a novel distinguishing feature of my invention is that the stud 27 does not contact the socket 28 as is the case with snap fasteners. Instead, the stud 27 and socket 28 are separated by the garment 21. Another distinguishing feature is that several sizes of oversize sockets 28 are required, for example, regular oversize, large oversize and extra large oversize to accommodate different garment thicknesses. The use of different sockets 28 with a common stud 27 also distinguishes my invention. As shown in FIG. 8, the blouse 21 is interposed between the stud 27 and socket 28 of the snap closure 22.

In FIGS. 14 through 17, an embodiment 30 is shown with multiple closures to attach an emblem 20 to a blouse 21. The embodiment 30 is comprised of a multi-piece emblem 20 with multiple studs 27 and a single piece backing 29 with multiple sockets 28.

From the foregoing, it is apparent that my invention provides an easy to use, efficient emblem and method heretofore unavailable which allows a sports team the flexibility of quickly changing without tools and special equipment the designation of a player on blouses and sweaters. Its use can substantially reduce scholastic and intramural costs and improve the performance of a sport.

Although only several embodiments have been illustrated and described, it will be apparent that other embodiments can be developed by changes that are obvious to persons skilled in the art, such as insignificant variations in thicknesses and compositions of materials, obvious substitutions of materials and obvious substitutions in the order and steps in our method without departing from the spirit thereof.

What I claim is new is:

1. The combination of a blouse of a player of a sports team and a thin detachable multi-layer emblem having a uniform thickness plastic or fabric overlying emblem layer and an attached underlying layer, said multi-layer emblem being adjacent an outer surface of said blouse, said overlying layer inscribed with an alpha-numeric character that designates a captain of a sports team; a stud member of a snap fastener attached to said thin flexible plastic or fabric underlying layer, a thin flexible plastic or fabric uniform thickness backing layer-adjacent to an inner surface of said blouse, opposite said multi-piece emblem; and an oversize socket member of a snap fastener for attaching said multi-layer emblem to said blouse; said oversize socket member selected from a group of oversize sockets of snap fasteners attached to said backing layer providing a space between said backing layer and said underlying emblem layer of said blouse, said socket member being in interlocking relationship with said stud member and said blouse therebetween.

2. An easy to use method for identifying the captain of a sports team on a blouse without piercing or otherwise changing the physical condition of said blouse, said method comprising the steps of: placing a flexible detachable multi-piece emblem comprised of an underlying layer containing a stud of a snap fastener and an overlying layer containing the letter "C" that identifies the captain of said sports team against an outer surface of said blouse, selecting an oversize annular socket member of said snap member from a group of sockets to provide space for said blouse between said stud of said snap fastener and said socket member, attaching the selected oversize socket member of said snap fastener to a plastic or fabric flexible backing layer against an inner surface of said blouse, opposite said multi-layer emblem and attaching said multi-piece emblem to said blouse by interlocking engaging said stud member and said socket member of said snap fastener with said garment therebetween.

3. The combination of blouse of a player of a sports team, a uniform thickness thin flexible or fabric multi-piece emblem adjacent to an outer surface of a blouse for instantly identifying on said blouse the captain of said sports team and a means for attaching said multi-piece emblem to said blouse, said combination comprising: said blouse of said player of said sports team; a thin flexible plastic or fabric overlying layer of said multi-piece emblem inscribed with the letter "C"; a thin flexible plastic or fabric underlying layer of said multi-piece emblem; a small thin flexible detachable plastic backing layer adjacent to an inner surface of said garment, and a snap fastener for quickly attaching and detaching said flexible plastic or fabric multi-piece emblem to said backing layer to interlock said multi-piece emblem layer to said backing layer to interlock said multi-piece emblem to said backing layer without altering the physical condition of said blouse, said snap fastener having a stud member of said snap fastener attached to an underlying layer of said emblem and an oversize annular socket member engaging said stud member for attaching said multi-piece emblem to said blouse, said oversize socket member spaced apart from said stud member by an amount which proves a space for said blouse between said stud member and said socket member.

4. The combination set forth in claim 3 wherein said outer emblem layer and said inner stud layer are triangular shaped layers.

5. In combination, a garment of a player of a sports team, a thin flexible alpha-numeric multi-layer emblem for quickly designating on said garment the status of said player of said sports team; a detachable thin flexible backing member; and means for quickly attaching and detaching said emblem to said garment without altering the physical condition of said garment, said means comprising a snap fastener, said fastener having a stud member attached to said thin flexible multi-layer emblem; and an oversize socket member attached to said thin flexible backing member adjacent to an inner surface of said garment for attaching said multi-layer emblem to said garment; said oversize socket member spaced apart from said stud member by an amount which provides a space for said garment, said garment positioned between stud member and said socket member.

6. The detachable amendment recited in claim 5 wherein said socket layer of said snap fastener is selected from a group of oversize sockets to provide said space for said blouse.

7. The combination recited in claim 5 wherein said overlying emblem member is inscribed with the letter "A" to indicate said player is an assistant captain of said sports team.

* * * * *